US006914563B2

(12) United States Patent
Chen et al.

(10) Patent No.: US 6,914,563 B2
(45) Date of Patent: Jul. 5, 2005

(54) LOW CROSS-POLARIZATION BROADBAND SUSPENDED PLATE ANTENNAS

(75) Inventors: Zhi Ning Chen, Singapore (SG); Michael Yan Wah Chia, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 0 days.

(21) Appl. No.: 10/470,326

(22) PCT Filed: Jan. 26, 2001

(86) PCT No.: PCT/SG01/00009

§ 371 (c)(1),
(2), (4) Date: Dec. 4, 2003

(87) PCT Pub. No.: WO02/060014

PCT Pub. Date: Aug. 1, 2002

(65) Prior Publication Data

US 2004/0066338 A1 Apr. 8, 2004

(51) Int. Cl.[7] ..... H01Q 1/38
(52) U.S. Cl. ..... 343/700 MS; 343/767
(58) Field of Search ..... 343/700 MS, 767, 343/768, 846, 847

(56) References Cited

U.S. PATENT DOCUMENTS

| | | | | |
|---|---|---|---|---|
| 4,613,868 A | * | 9/1986 | Weiss | 343/700 MS |
| 4,987,423 A | | 1/1991 | Bouko et al. | 343/741 |
| 5,005,019 A | * | 4/1991 | Zaghloul et al. | 343/700 MS |
| 5,621,422 A | * | 4/1997 | Wang | 343/895 |
| 5,633,645 A | * | 5/1997 | Day | 343/700 MS |
| 6,593,887 B2 | * | 7/2003 | Luk et al. | 343/700 MS |

FOREIGN PATENT DOCUMENTS

| | | |
|---|---|---|
| JP | 63 222503 | 9/1988 |
| JP | 07 297628 | 11/1995 |
| JP | 11 266118 | 9/1999 |

OTHER PUBLICATIONS

Huynh and Lee, "Single–layer single patch wideband microstrip antenna," *Electronics Letters*, vol. 31, pp. 1310–1312 (1995).

N. Herscovici, "A Wide–band single–layer patch antenna," *IEEE Trans. Antennas and Propagat*, vol. 24, pp. 471–473 (1998).

Luk, et al., "Broadband microstrip antenna," *Electronics Letters*, vol. 34, pp. 1442–1443 (1998).

Chen, et al., "Broadband probe–fed plate antenna," 30$^{th}$ *European Microwave Conference, Paris France*, vol. 2, pp 182–185, (2000).

Chen, et al., "Broadband rectangular slotted plate antenna," *Proc. IEEE Antenna and Propagat. Symp., Salt Lake City, Utah, USA*, vol. 2, pp. 640–643 (2000).

Hall, "Probe compensation in thick microstrip patches," *Electronics Letters*, vol. 23, pp. 606–607 (1987).

Petosa, et al., "Suppression of unwanted probe radiation in wideband probe–fed microstrip patches," *Electronic Letters*, vol. 35, pp. 355–357 (1999).

* cited by examiner

*Primary Examiner*—Shih-Chao Chen
(74) *Attorney, Agent, or Firm*—Wilmer Cutler Pickering Hale and Dorr LLP

(57) ABSTRACT

A suspended plate antenna for broadband applications is disclosed. The antenna comprises a plate radiator, a slot cut in the plate radiator, and a substantially balanced feeding structure symmetrically feeding the plate radiator with respect to at least one midline of the plate radiator.

20 Claims, 7 Drawing Sheets

Fig.1a
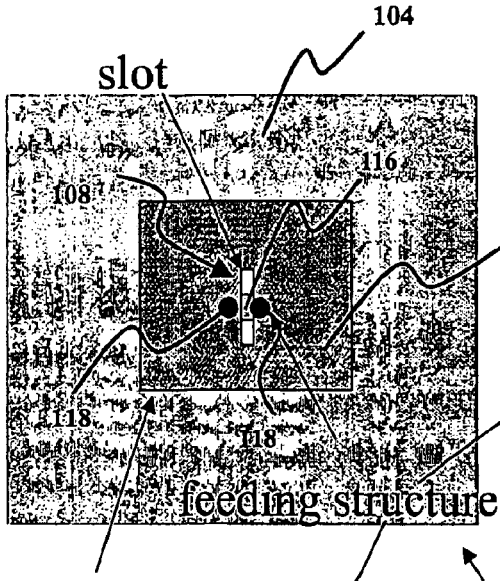
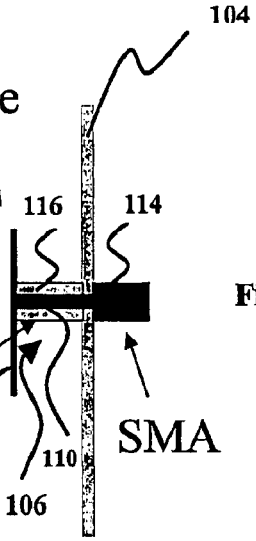
Fig. 1b
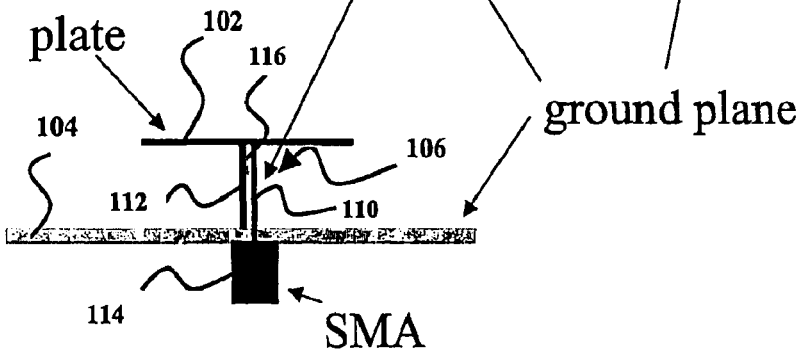
Fig. 1c 404
402
slot
408
418
416
feeding plate
413
404
416
414
402
418
410
406
SMA plate
406
416
402
410
B
A
412
ground plane

404
SMA
414
413
A
B
412
413
416 probe-feed
410
grounded 504
slot
518
518
502
508
feeding point
plate
502
ground plane
-90°
90°
510
510
504
514
506
balance feeder
balance feeder
504
plate
502
510
514

604
slot 608
602
SMA
604
plate
614
602
610 feeding strip
plate
612
602
610
grounded
ground plane
SMA
604
614

LOW CROSS-POLARIZATION BROADBAND SUSPENDED PLATE ANTENNAS

FIELD OF INVENTION

The invention relates generally to planar antennas, and more particularly to broadband suspended plate antennas.

BACKGROUND

In designing planar antennas for use in wireless communication systems, the typical goals set are to achieve powerful performance with low structural profiles, low costs of manufacture, ease of manufacture, and ease of integration with other communication devices. However, conventional planar antennas such as microstrip patch antennas and basic types of planar inverted-L or -F antennas (ILA or IFA) have inherent narrow impedance bandwidths, which typically are of measures of a few percent. This drawback adversely affects the usefulness of these conventional planar antennas in broadband applications. Therefore, many techniques have been proposed for alleviating the narrow impedance bandwidth problem.

For microstrip patch antennas, the proposals typically include the addition of parasitic elements, the use of electrically thick substrates, or the introduction of matching networks. For the planar ILAs or IFAs, the proposals typically include replacing wire radiators with planar radiators and/or loading the planar antennas with high permittivity material.

The techniques proposed for alleviating the narrow impedance bandwidth problem have drawbacks. Adding parasitic elements vertically or laterally to microstrip patch antennas increases the sizes, costs and complexity of manufacture of such planar antennas. Using electrically thick substrates in microstrip patch antennas increases the costs of manufacture and lowers the radiation efficiency of such planar antennas due to the increased surface waves and dielectric loss. Introducing matching networks to microstrip patch antennas reduces the radiation efficiency and complicates the design and fabrication of these planar antennas. The ILAs or IFAs usually have low polarization purity and are therefore not suitable for applications requiring purely polarized waves, for example in polarization diversity applications. The planar ILAs or IFAs that are loaded with materials of high permittivity have large sizes and involve high costs of manufacture.

In a number of articles, a type of suspended plate antennas is proposed to further improve impedance bandwidths for such planar antennas. The articles include: T. Huynh and K. F. Lee's "Single-layer single patch wideband microstrip antenna," *Electronics Letters*, vol.31, pp.1310–1312, 1995; N. Herscovici's "A wide-band single-layer patch antenna," *IEEE Trans. Antennas and Propagat.,* vol.46, pp.471–473, 1998; and K. M. Luk, C. L. Mak, Y. L. Chow, and K. F. Lee's "Broadband microstrip antenna," *Electronics Letters*, vol. 34, pp.1442–1443, 1998. The proposed suspended plate antennas are placed at a height of approximately 0.1 times the operating wavelength above a ground plane. A variety of matching techniques is introduced to these planar antennas for realising good matching conditions in broadband applications. The ameliorated impedance bandwidth typically is of a measure ranging from 10% to 40% for signals at 2:1 voltage standing wave ratio (VSWR).

In Table 1, measurements relating to the critical performances of three types of conventional low-profile planar antennas are tabulated for comparison. The suspended plate antenna is shown to be more suited for broadband applications.

TABLE 1

Comparison of critical performance measures of conventional planar antennas with low profiles

| Antenna | Efficiency | Bandwidth | Polarization Purity | Size/Cost |
|---|---|---|---|---|
| Microstrip patch antennas | Low | <10% | Good | Fair (low profile)/ high |
| Inverted L- or F-antennas | High | <10% | — | Fair (low profile)/ low |
| Suspended plate antennas | High | 10~40% | Bad (>−15 dB) | Fair (low profile)/ low |

The proposed suspended plate antennas greatly alleviate the narrow impedance bandwidth problem, usually fed by probe-type feeds because a variety of matching techniques has been used to realise good matching conditions for such planar antennas. However, the undesirable higher-order modes and the asymmetric feeding schemes result in seriously degraded radiation performance of these planar antennas. The high cross-polarization levels and the distorted radiation patterns to a great extent limit practical applications of the suspended plate antennas, where planar antennas of high polarization purity, such as arrays and polarization diversity designs, are required. For example, dual-polarization base stations usually require planar antennas with high polarization purity. This drawback therefore severely limits the scope of practical applications of broadband suspended plate antennas.

Techniques are therefore proposed for compensating the degraded radiation performance. A number of articles (Z. N. Chen and M. Y. W. Chia's "Broadband probe-fed plate antenna," $30^{th}$ *European Microwave Conference,* Paris, France, vol.2, pp.182–185, October 2000; and Z. N. Chen and M. Y. W. Chia's "Broadband rectangular slotted plate antenna," *Proc. IEEE Antennas and Propagat. Symp.,* Slat Lake City, Utah, USA, vol. 2, pp.640–643, July 2000) proposed the replacement of U-shaped slots in such planar antennas with Ω-shaped slots or narrow notches. Compared to suspended plate antennas that have slots with U-shapes or large aspect ratios, suspended plate antennas with Ω-shaped slots or narrow notches have lower cross-polarization levels. This is because the effect of such slots on current distributions at the plate radiators is reduced and as a result the higher order modes are to some degree suppressed. However, the cross-polarization levels of suspended plate antennas with Ω-shaped slots are still high although such levels have been lowered by about 2 dB when compared with suspended plate antennas with U-shaped slots, since the higher order modes are not suppressed completely and the plate radiators are still fed asymmetrically.

In other articles (P. S. Hall's "Probe compensation in thick microstrip patches," *Electronics Letters*, vol. 23, pp.606–607, 1987; and A. Petosa, A. Ittipiboon, and N. Gagnon's "Suppression of unwanted probe radiation in wideband probe-fed microstrip patches," *Electronics Letters*, vol. 35, pp.355–357, 1999), dual-feeding structures are proposed for use on such planar antennas to ease the serious degraded radiation performance of these planar antennas. A pair of probes with a phase shift of 180° is located symmetrically about the mid-line of radiators. The demand of a 180° phase shift leads to the implementation of a complex feeding network because to design such a broadband phase shifter is difficult. Additionally, this proposal leads to the lowering of only the cross-polarization levels in the H-plane.

There is therefore a need for a broadband suspended plate antenna with a feeding structure and a method therefor, which alleviates cross-polarization levels in the H-planes and distorted radiation patterns in the E-planes.

SUMMARY

In accordance with a first aspect of the invention, a suspended plate antenna for broadband applications is provided. The antenna comprises a plate radiator, a slot cut in the plate radiator, and a substantially balanced feeding structure symmetrically feeding the plate radiator with respect to at least one midline of the plate radiator.

In accordance with a second aspect of the invention, a method for feeding a suspended plate antenna for broadband applications is provided. The method comprises the steps of providing a plate radiator, providing a slot cut in the plate radiator, and using a substantially balanced feeding structure for symmetrically feeding the plate radiator with respect to and close to the center of the plate radiator.

BRIEF DESCRIPTION OF THE DRAWINGS

Embodiments of the invention are described hereinafter with reference to the drawings, in which:

FIGS. 1*a*, 1*b*, and 1*c* are front, side and bottom elevations, respectively, of a suspended plate antenna with a pair of structural symmetrical microstrip lines for a balanced feeding structure according to a first embodiment of the invention;

DETAILED DESCRIPTION

Figure 2A:
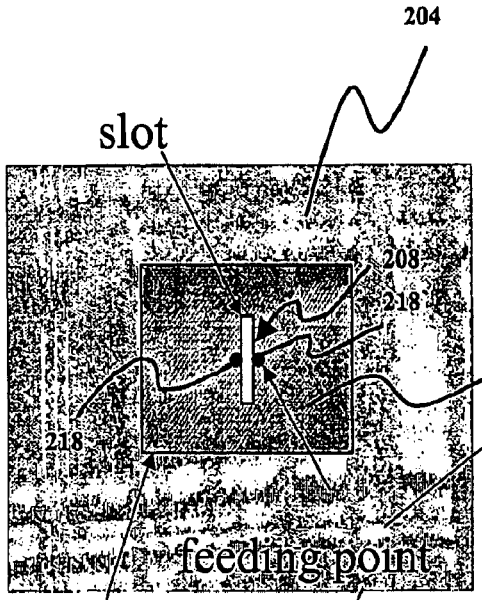
FIGS. 2*a*, 2*b*, and 2*c* are front, side and bottom elevations, respectively, of a suspended plate antenna with a pair of close parallel wires for a balanced feeding structure according to a second embodiment of the invention, and FIG. 2*d* provides an enlarged front view of this feeding structure.

Broadband suspended plate antennas with feeding structures, and a method therefor, which alleviate high cross-polarization levels in the H-planes and distorted radiation patterns in the E-planes are described hereinafter.

With the rapid development of wireless communication techniques, demand is increasing for antennas that are small, involve low costs of manufacture, and provide high performance. To afford wireless communication devices with mobility and allow for sectorization of wireless communication base station antennas, compact antennas are typically required. The low costs inherent in manufacturing ease and inexpensive materials usage in relation to antennas usually attract, and therefore encourage, industrial applications of such antennas. The high performance leading to broad impedance bandwidth and stable radiation characteristics with low cross-polarization levels crossing the well-matched impedance pass-band, allows antennas to meet the needs of modern wireless communication systems. Therefore, much effort is devoted to the development of compact broadband antennas.

As part of this development process, suspended plate antennas or microstrip patch antennas which are fed at the center of plate radiators of such antennas symmetrically about midlines of the plate radiators by balanced feeding structures are proposed. In a balanced feeding structure, a pair of ports is used to feed out of phase (180 degrees phase shift) currents of the same magnitude to the plate radiators. The resultant radiation performance of the respective antenna is improved within a broad well-matched pass-band.

Suspended plate antenna configurations with feeding structures according to embodiments of the invention are therefore provided to ameliorate the degraded radiation performance in the broad well-matched impedance pass-band. More specifically, a suspended plate antenna with an electrically thin slot cut symmetrically with respect to midlines of the antenna's plate radiator is symmetrically fed at the center of the plate radiator in the proximity of the slot by a balanced feeding structure.

A suspended plate antenna having a plate radiator and a feeding structure with four ports in which the feeding structure feeds the plate radiator across a slot cut at the center of the plate radiator is shown in FIGS. 1*a*, 1*b*, and 1*c*. Such a suspended plate antenna is different from conventional planar antennas with asymmetrical and balanced feeding structures, for example microstrip patch antennas, because a balanced feeding structure is used to symmetrically feed the plate radiator at the center of the plate radiator. Other balanced or substantially balanced feeding structures, such as a pair of thin wires, a pair of microstrip lines, CPW-like feeding lines, balanced feeding probes, or a pair of inverted-L feeding strips are used as shown in FIGS. 2*a* to 6*c*, respectively. By means of such feeding structures and methods, the distribution of the induced cross-polarized electric currents at the higher operating frequencies in the well-matched pass-band is symmetrical and anti-phase in the E- and H-planes not only in bore-sight direction but also in almost all directions. Furthermore, the unwanted radiation resulting from the higher order modes is canceled out well because the induced cross-polarized electric currents mainly exist near the slot. As a result, the low cross-polarization levels in the H-planes, typically of measures lower than −20 dB, and the improved radiation patterns in the E-plane are attained within a broad well-matched impedance band.

There are a number of attendant advantages associated with the embodiments of the invention described hereinafter. For example, a feeding structure design concept is provided. Based on an understanding of the degraded radiation performance in broadband suspended plate antennas, a design concept for feeding structures is provided to ameliorate the degraded radiation performance of suspended plate antennas within a broad well-matched impedance band. Using this concept, the unwanted radiation significantly contributed by the higher order modes is effectively suppressed by improving the induced electric current distribution caused by the higher order modes. The design concept is therefore useful and helpful to develop new techniques to improve the radiation performance of broadband suspended plate antennas.

As another example, feeding methods for suspended plate antennas are provided. Based on the foregoing design concept, the feeding methods are provided to ameliorate the radiation performance of the suspended plate antennas within the broad impedance pass-band, in which only one balanced or balanced-like feeding structure with simple feeding network is used. The feeding methods not only simplify feeding networks for suspended plate antennas greatly but also ease the manufacturing and lower the manufacturing cost of suspended plate antennas.

As a further example, better radiation performance is achieved for suspended plate antennas according to embodiments of the invention. Using the feeding methods, the radiation performance of the suspended plate antennas are further improved within the broad impedance pass-band by locating the feed-point at or symmetrically with respect to the midline of the plate radiator. In this way, a more efficient cancellation of the unwanted radiation caused by distorted currents at the plate radiator is achieved, the distorted currents being the result of the higher order modes or asymmetric feeding structures.

The performance measures and structural features of broadband suspended plate antennas fed by a conventional dual-feeding system and a feeding structure according to an embodiment of the invention are compared in Table 2. The information provided in Table 2 suggests that a broadband suspended plate antenna equipped with a feeding structure according to an embodiment of the invention is more attractive in the context of industrial applicability.

TABLE 2

Comparison of feeding system proposals for improving the radiation performance of broadband suspended plate antennas

| Solutions | Ratio of cross-/co-polarization levels in E-planes | Co-polarization patterns in H-planes | Broadband feeding network | Beam-width for <−20 dB cross-polarization level in E-plane |
|---|---|---|---|---|
| Dual-feeding | −18 dB | Good | Complicated | Few degrees |
| Embodiment of the invention | <−20 dB | Good | Simple | 90 degree |

Embodiments of the invention that relate to a class of suspended plate antennas fed by simple feeding structures are described in greater detail hereinafter with reference to FIGS. 1 to 6. Methods by which the suspended plate antennas are fed by the various feeding structures leading to the achievement of performance characteristics of low cross-polarization levels within a broad well-matched impedance pass-band, typically lower than −20 dB, are also described in greater detail hereinafter.

The various feeding structures and methods therefore are based on an understanding of the degraded radiation characteristics of suspended plate antennas, in which techniques are developed to symmetrize the cross-polarized induced electric currents with anti-phase in the plate radiators of the suspended plate antennas due to the generation of higher order modes, which degrade the radiation performance, by feeding the plate radiators in a symmetrical and balanced manner. This is because within a broad well-matched impedance pass-band, high cross-polarization levels in the H-plane and seriously distorted radiation patterns in E-plane result mainly from the excitation of undesired higher order modes and/or the asymmetrical distribution of induced currents in the plate radiators.

Figures 6A, 6B, 6C:
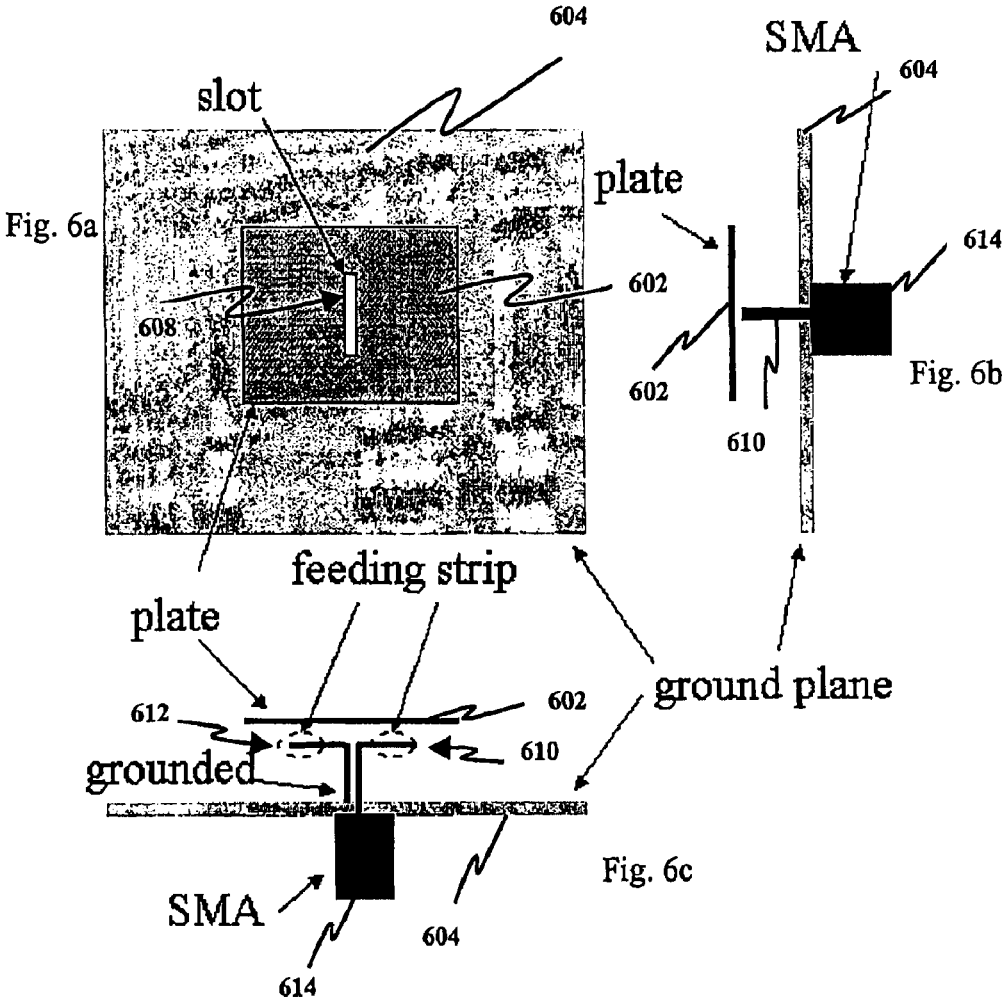
FIGS. 6*a*, 6*b*, and 6*c* are front, side and bottom elevations, respectively, of a suspended plate antenna with a pair of inverted-L feeding strips for a balanced feeding structure according to a sixth embodiment of the invention.
Figure 7A:
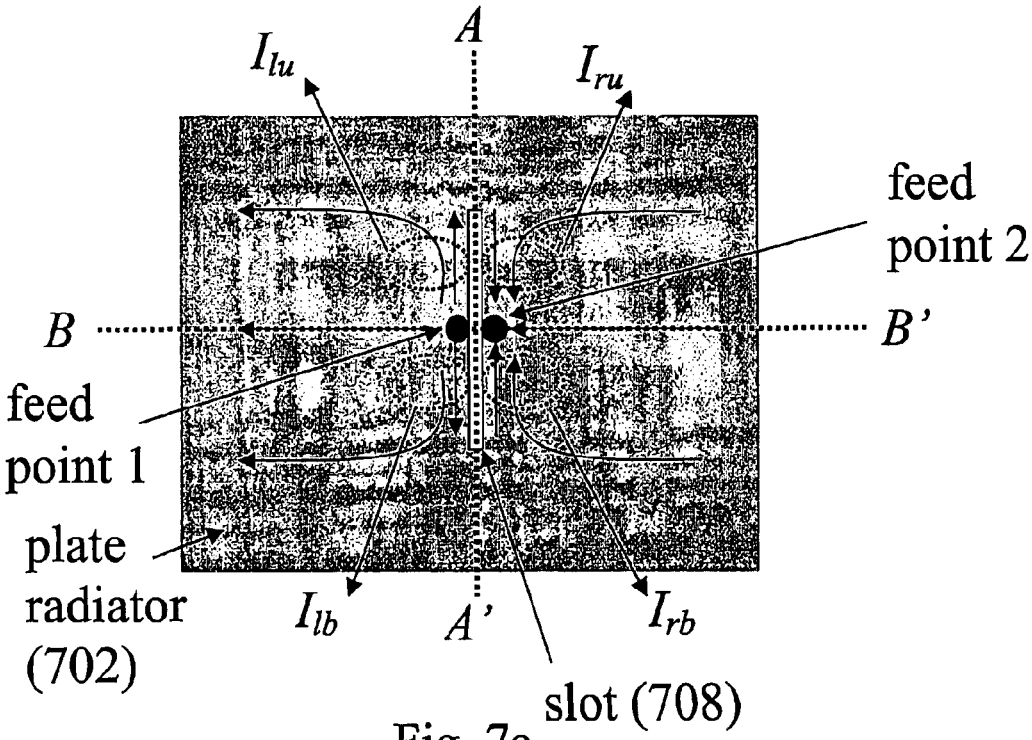
FIGS. 7*a* and 7*b* show the distribution of induced electric currents on the surface of a plate radiator of any suspended plate antenna shown in FIGS. 1 to 6.
Figure 7B:
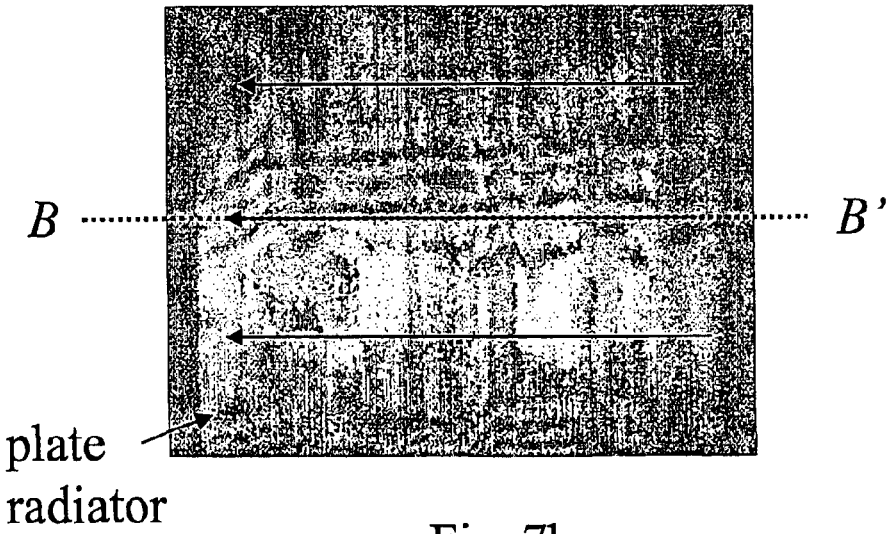
Figures 4A, 4B, 4C, 4D, 4E:
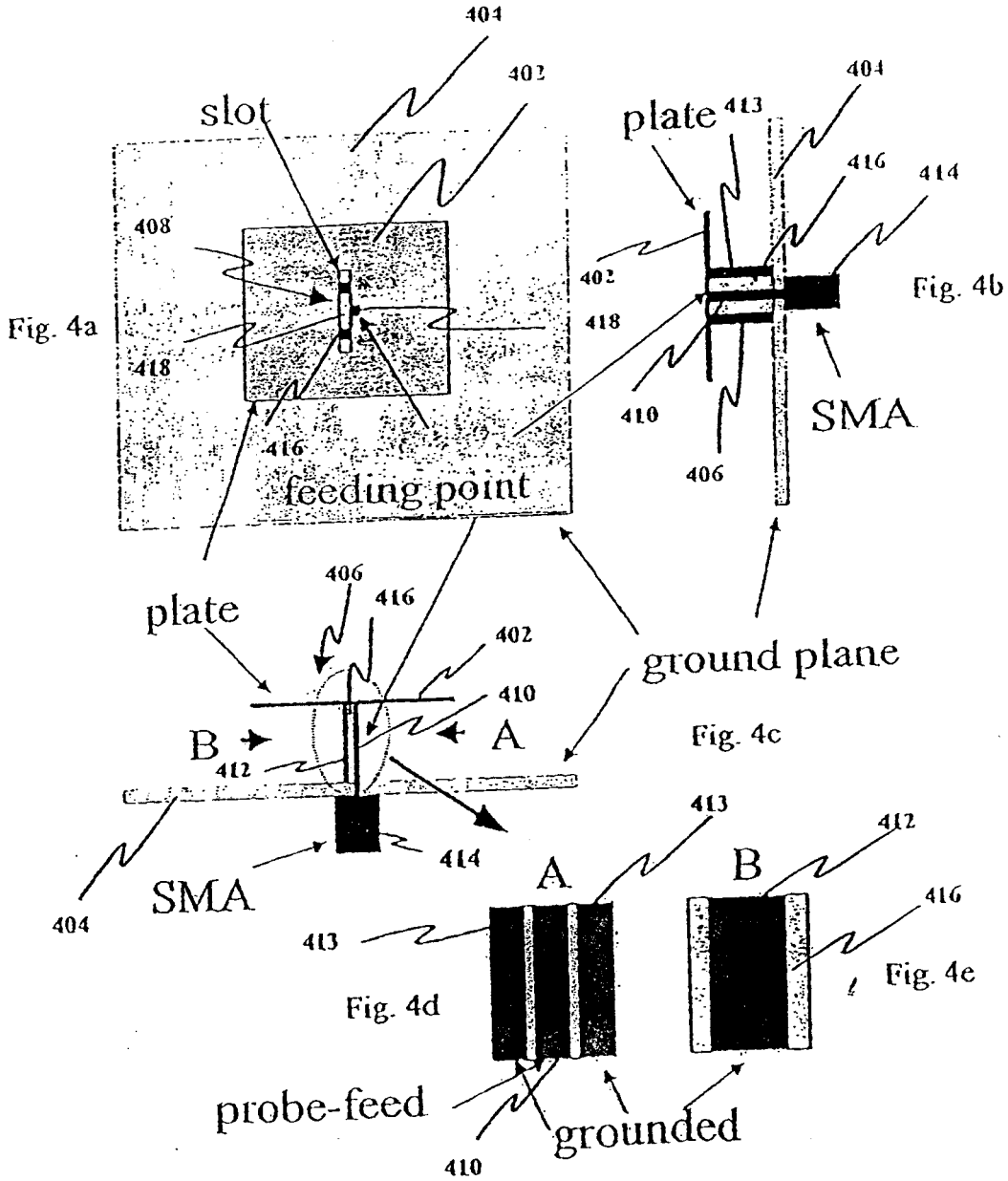
Figures 6A, 6B, 6C:
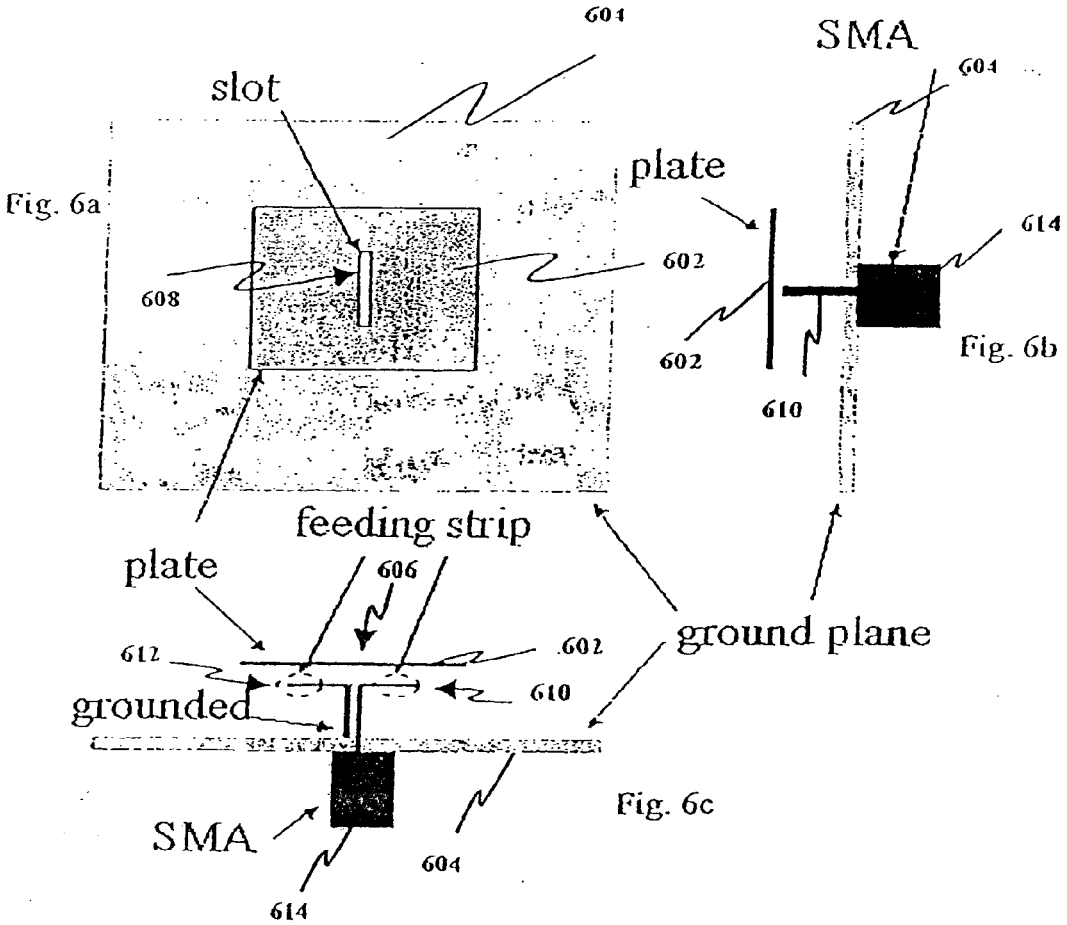

The distribution of induced electric currents in the plate radiators of the suspended plate antennas as shown in FIGS. 1 to 6 attendant on the implementation of such embodiments is described in greater detail with reference to FIGS. 7*a* and 7*b*. As shown in FIG. 7*a*, the induced electric current distribution at a plate radiator 702 is achieved by cutting a narrow rectangular slot 708 in the plate radiator 702 of a suspended plate antenna symmetrically about both midlines of the plate radiator 702, namely A–A' and B–B' lines, and feeding the plate radiator 702 at the center with a balanced feeding structure with feed points 1 and 2. The feeding points 1 and 2 are located along midline B–B' and symmetrical about midline A–A'.

During operation, the excitation patterns of electric currents at or about feed points 1 and 2 are equal but out of phase (180 degrees phase shift), and both co- and cross-polarized electric currents are excited. The co-polarized electric currents lie along the line B–B' and contribute to the co-polarization radiation, while the cross-polarized electric currents lie along the A–A' and contribute the cross-polarization radiation. The induced electric current distribution is symmetrical about both midlines A–A' and B–B'. The cross-polarized components ($I_{lu}$, $I_{lb}$, $I_{ru}$, and $I_{rb}$) of the induced currents are of equal magnitude and mainly occur near the narrow rectangular slot 708. Therefore, the unwanted radiation from the cross-polarized components ($I_{lu}$, $I_{lb}$, $I_{ru}$ and $I_{rb}$) can be cancelled in all directions. The improved radiation is equivalent to the radiation from an ideal electric current distribution on a plate radiator without a slot as shown in FIG. 7*b*, where only co-polarized electric currents are excited.

The front, side and bottom elevations of a rectangular suspended plate antenna according to a first embodiment of the invention are shown in FIGS. 1*a*, 1*b*, and 1*c*, respectively. A highly conductive and electrically thin rectangular plate radiator 102 is suspended in parallel to a ground plane 104 typically at a distance approximately 0.1 times the operating wavelength of the rectangular plate antenna for broadening the impedance bandwidth. A probe-type feeding structure 106 is used because of the large spacing between the plate radiator 102 and the ground plane 104. An electrically narrow rectangular slot 108 is cut preferably in the center of the plate radiator 102, in which the rectangular slot 108 is longitudinally symmetrical about the line joining the midpoints of the longer sides of the rectangular plate radiator 102, and laterally symmetrical about the line joining the midpoints of the shorter sides of the rectangular plate radiator 102. The plate radiator 102 may be completely or partially supported by electrically thin or thick air, foam, or any other infinitely- or finitely-sized dielectric material which is inserted into the space between the plate radiator 102 and the ground plane 104.

Variations of the plate radiator 102 maybe used. For example, instead of being rectangular, the plate radiator 102 may have a shape, which is triangular, trapezoidal, circular, or bow-tie-like, or any variation of these shapes. The plate radiator 102 may also be notched or have multiple slots cut in the center of the plate radiator 102 instead of having a single slot. The plate radiator 102 may also be of a single-layer, single-element, or stacked configuration, or contains vertical or lateral parasitic elements.

For purposes of brevity, only the structures of the plate radiator 102 and the ground plane 104 are described in detail. The structures of plate radiators 202, 302, 402, 502, and 602 and ground planes 204, 304, 404, 504, and 604 of the second to sixth embodiments of the invention, respectively, in general have features or characteristics that are similar with features or characteristics of the plate radiator 102 and ground plane 104. The second to sixth embodiments of the invention and the respective features or characteristics are illustrated in FIGS. 2 to 6, respectively. Such similar features or characteristics in the plate radiators 202, 302, 402, 502, and 602 and ground planes 204, 304, 404, 504, and 604 of the second to sixth embodiments are therefore designated by reference numerals that correspond to reference numerals designating the corresponding parts or features of the plate radiator 102 and ground plane 104.

Preferably, the probe-type feeding structure 106 is balanced and configured to feed the suspended plate antenna symmetrically about the midlines of the plate radiator 102. In this instance, the probe-type feeding structure 106 is a microstrip line fed by a probe feed 110 that is spaced apart from and in parallel with a ground wall 112 as shown in FIGS. 1*a*, 1*b*, and 1*c*. The ground wall 112 maybe narrow or wide, provided that the width of the ground wall 112 is approximately equal to the width of the probe feed 110.

The probe feed 110, to which electrical signals are fed, is connected to a surface mount adapter (SMA) conductor 114 via a feedthrough in the ground plane 104 while the ground wall 112 is connected to the ground plane 104 in the proximity of the feedthrough. The ground point of the SMA conductor 114 is also connected to the ground plane 104 in the proximity of the feedthrough, but on the side of the ground plane 104 opposite the plate radiator 102. Input to or output from the suspended plate antenna is fed to the SMA conductor 114 and connected to external wireless communication devices.

The probe feed 110 and the ground wall 112 may be completely or partially separated by foam, or any other infinitely- or finitely-sized dielectric material 116 that is inserted into the space between the probe feed 110 and the ground wall 112.

A pair of feed points 118 are present on the plate radiator 102, each feed point 118 being located at the center of and proximal to the edge of each of the opposing longer sides of the rectangular slot 108. Each of the probe feed 110 and ground wall 112 is connected to each of the pair of feed points 118 for symmetrically feeding the plate radiator 102.

Figure 2B:
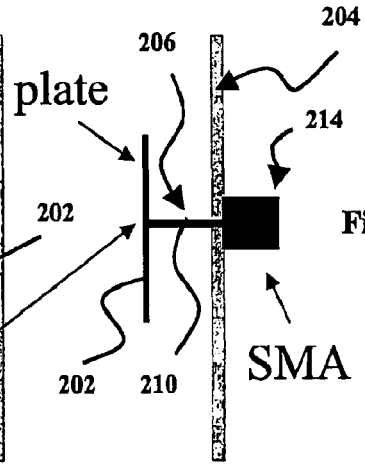
Figure 2C:
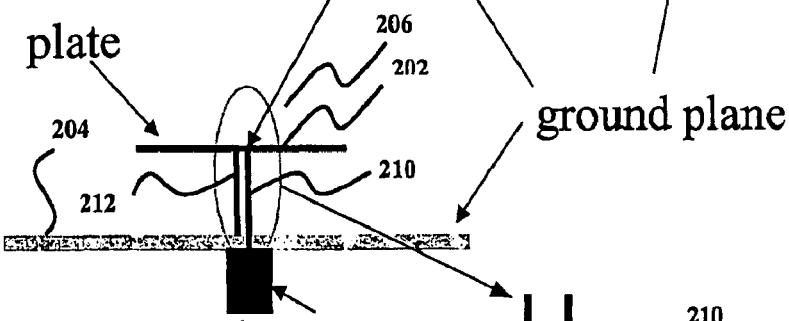
Figure 2D:
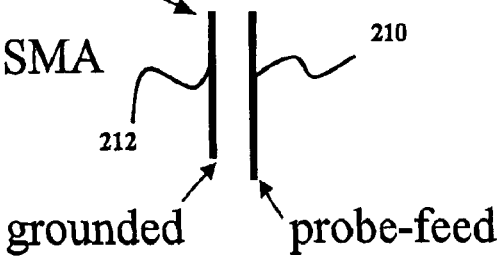
Figures 3A, 3B, 3C, 3D, 3E:
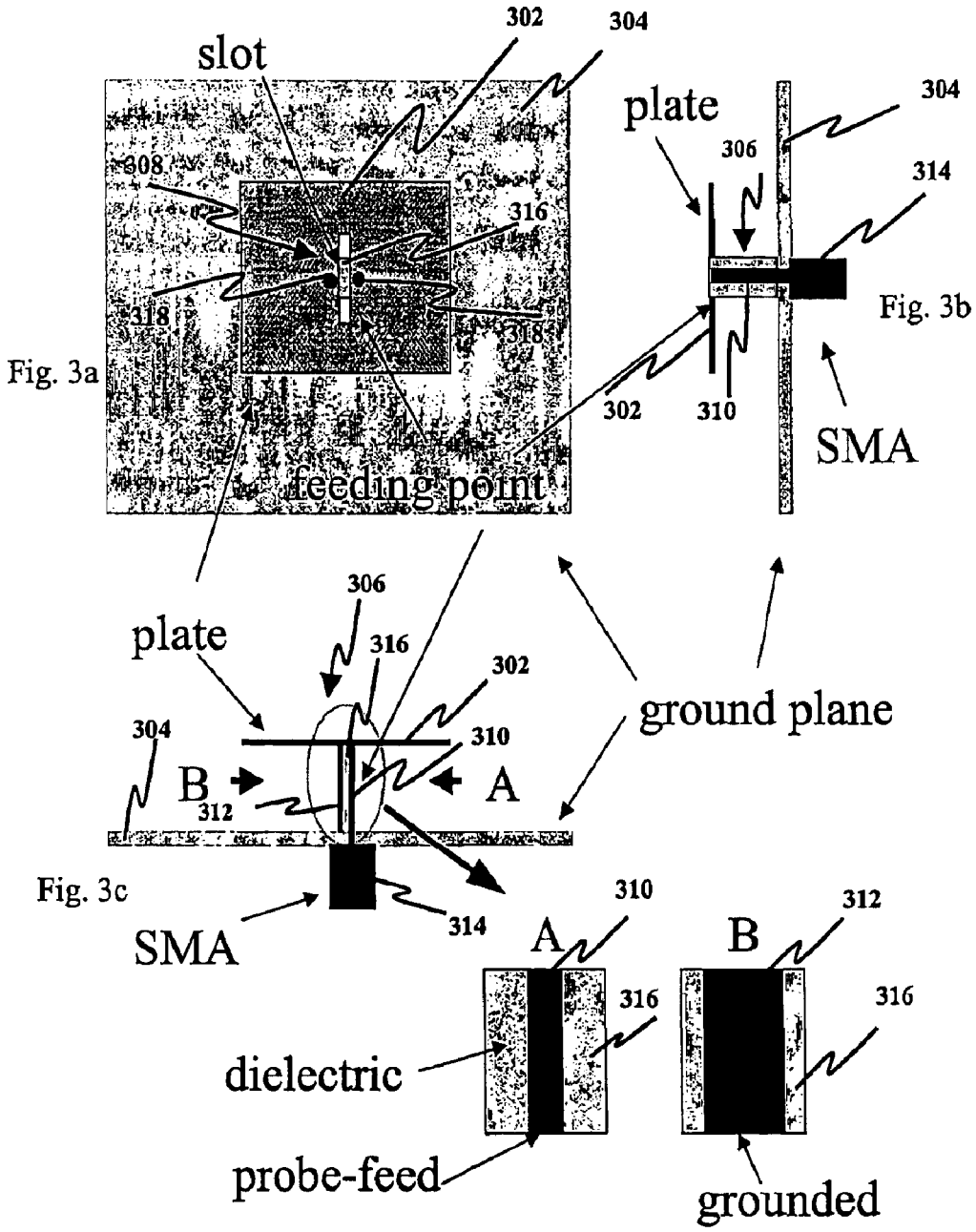
FIGS. 3*a*, 3*b*, and 3*c* are front, side and bottom elevations, respectively, of a suspended plate antenna with a pair of structural asymmetrical microstrip line for a balanced feeding structure according to a third embodiment of the invention, and FIGS. 3*d* and 3*e* provide enlarged right and left views, respectively, of this feeding structure.
Figures 4A, 4B, 4C, 4D, 4E:
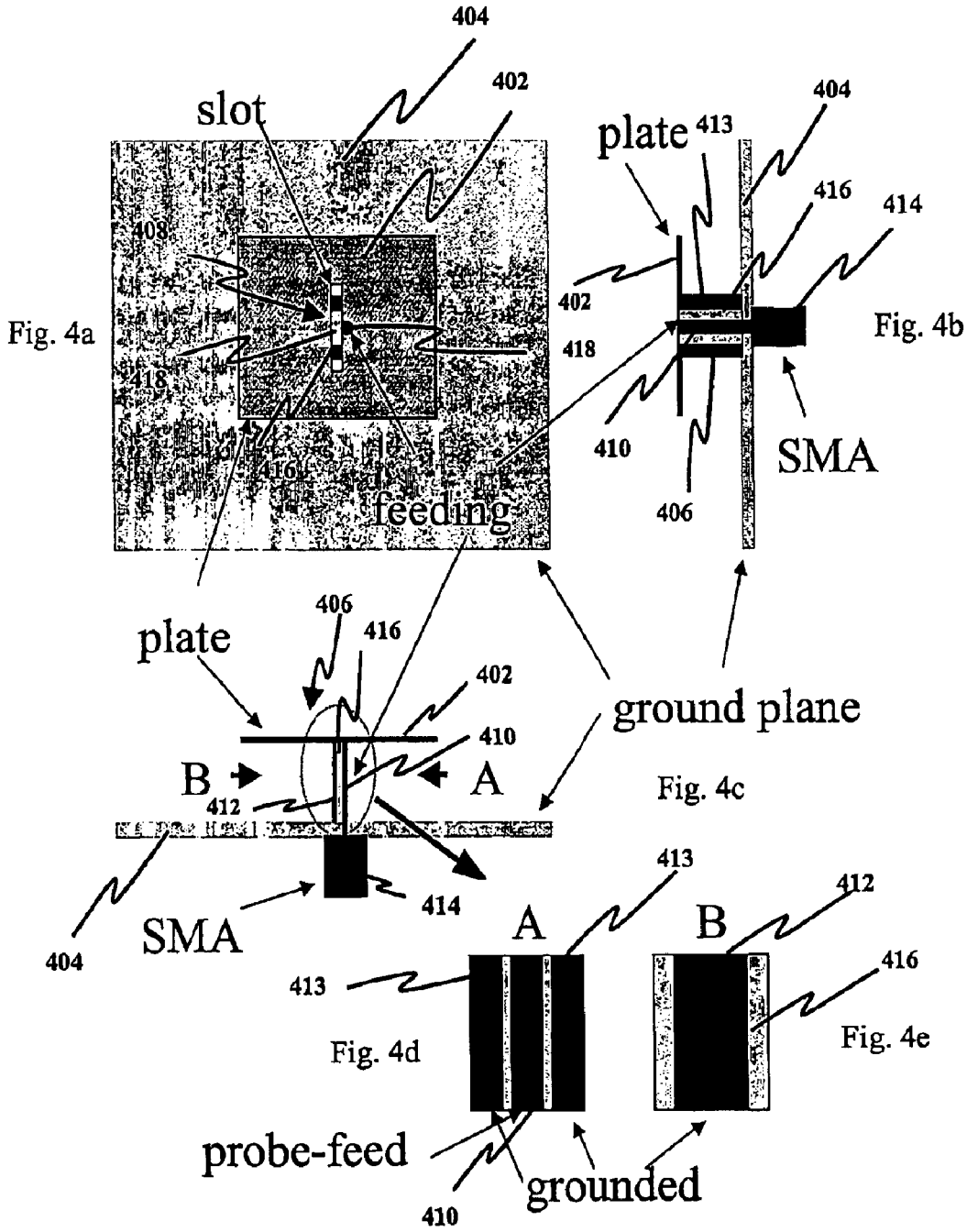
FIGS. 4*a*, 4*b*, and 4*c* are front, side and bottom elevations, respectively, of a suspended plate antenna with a coplanar waveguide (CPW)-like structure for a balanced feeding structure according to a fourth embodiment of the invention, and FIGS. 4*d* and 4*e* provide enlarged right and left views, respectively, of this feeding structure.
Figures 5A, 5B, 5C:
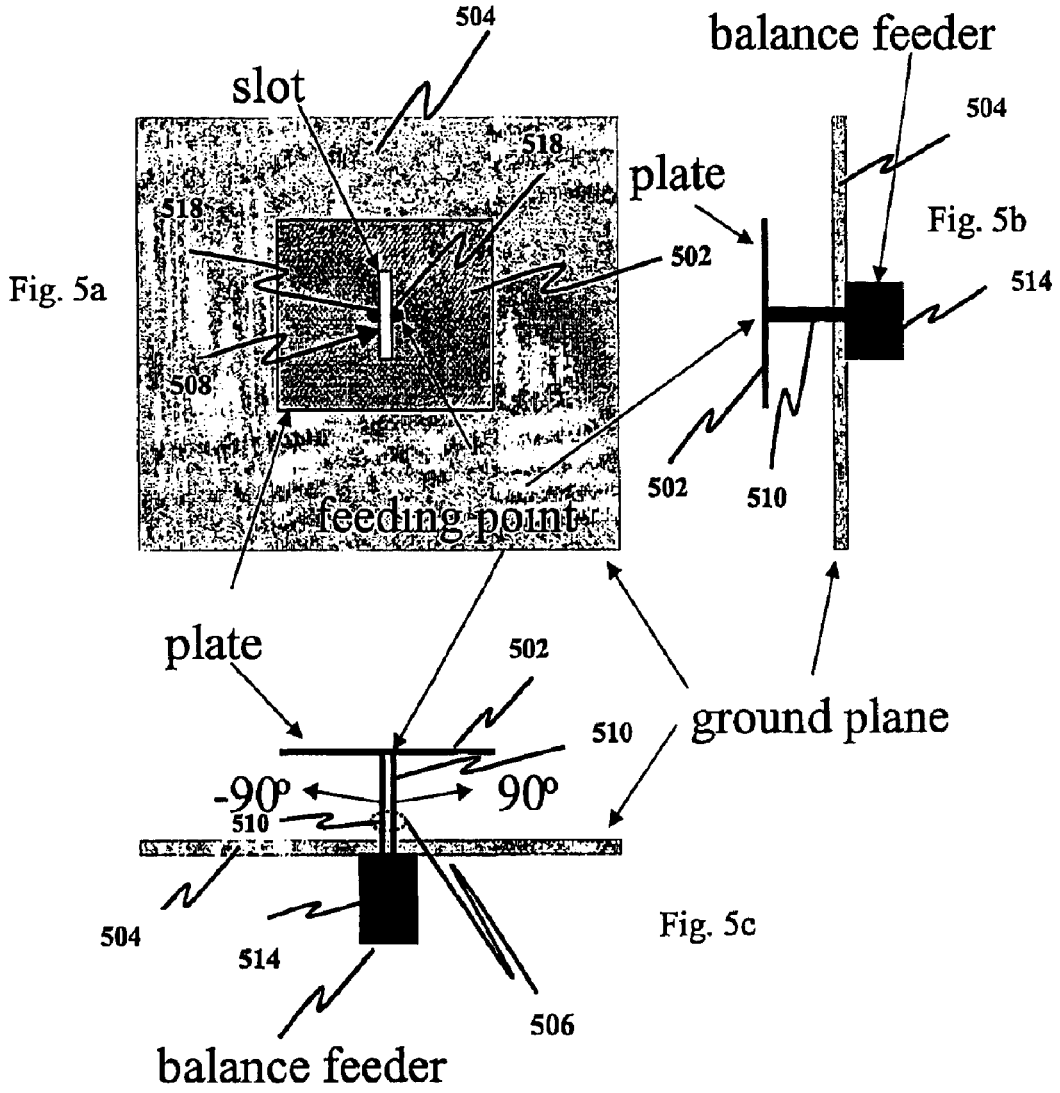
FIGS. 5*a*, 5*b*, and 5*c* are front, side and bottom elevations, respectively, of a suspended plate antenna with a two parallel-conductor line system for a balanced feeding structure according to a fifth embodiment of the invention.

In relation to the other embodiments of the invention, the balanced feeding structures are preferably probe feeds consisting of a pair of close parallel wires 206 which is electrically connected to the plate radiator symmetrically as shown in FIGS. 2*a*, 2*b*, and 2*c*, and a pair of microstrip lines 306 as shown in FIGS. 3*a*, 3*b*, or 3*c* according to the second and third embodiments, respectively. The balanced feeding structures are also preferably a CPW-like probe-feed 406 as shown in FIGS. 4*a*, 4*b*, or 4*c*, and a balanced feeding system 506 as shown in FIGS. 5*a*, 5*b*, and 5*c* according to the fourth and fifth embodiments, respectively. The balanced feeding structure is further preferably a pair if inverted-L feeding strips 606 as shown in FIGS. 6*a*, 6*b*, and 6*c* according to the sixth embodiment.

The balanced feeding structure of the second embodiment is described in greater detail with reference to FIGS. 2*a*, 2*b*, and 2*c*. Preferably, the probe-type feeding structure 206 is balanced and configured to feed the suspended plate antenna symmetrically about the center of the plate radiator 202. In this instance, the probe-type feeding structure 206 is a pair of close parallel wires 206 that consists of a probe feed 210 that is spaced apart from and in parallel with a ground wire 212 as shown in FIGS. 2*a*, 2*b*, and 2*c*. The ground wire 212 is disposed close to and in parallel with the probe feed 210.

The probe feed 210, to which electrical signals are fed, is connected to a surface mount adapter (SMA) conductor 214 via a feedthrough in the ground plane 204 while the ground wire 212 is connected to the ground plane 204 in the proximity of the feedthrough The ground point of the SMA conductor 214 is also connected to the ground plane 204 in the proximity of the feedthrough, but on the side of the ground plane 204 opposite the plate radiator 202. Input to or output from the suspended plate antenna is fed to the SMA conductor 214 and connected to external wireless communication devices.

A pair of feed points 218 are present on the plate radiator 202, each feed point 218 being located at the center of and proximal to the edge of each of the opposing longer sides of a rectangular slot 208 cut in the center of the plate radiator 202 as described in the foregoing manner for the first embodiment. Each of the probe feed 210 and ground wire 212 is connected to each of the pair of feed points 218 for symmetrically feeding the plate radiator 202.

The balanced feeding structure of the third embodiment is described in greater detail with reference to FIGS. 3*a*, 3*b*, and 3*c*. Preferably, the probe-type feeding structure 306 is balanced and configured to feed the suspended plate antenna symmetrically about the center of the plate radiator 302. In this instance, the probe-type feeding structure 306 is a microstrip line fed by a probe feed 310 that is spaced apart from and in parallel with a ground wall 312 as shown in FIGS. 3*a*, 3*b*, and 3*c*. The width of the ground wall 312 is typically greater than the width of the probe feed 310.

The probe feed 310, to which electrical signals are fed, is connected to a surface mount adapter (SMA) conductor 314 via a feedthrough in the ground plane 304 while the ground wall 312 is connected to the ground plane 304 in the proximity of the feedthrough. The ground point of the SMA conductor 314 is also connected to the ground plane 304 in the proximity of the feedthrough, but on the side of the ground plane 304 opposite the plate radiator 302. Input to or output from the suspended plate antenna is fed to the SMA conductor 314 and connected to external wireless communication devices.

The probe feed 310 and the ground wall 312 may be completely or partially separated by foam, or any other infinitely- or finitely-sized dielectric material 316 that is inserted into the space between the probe feed 310 and the ground wall 312.

A pair of feed points 318 are present on the plate radiator 302, each feed point 318 being located at the center of and proximal to the edge of each of the longer sides of a rectangular slot 308 cut in the center of the plate radiator 302 as described in the foregoing manner for the first embodiment. Each of the probe feed 310 and ground wall 312 is connected to each of the pair of feed points 318 for symmetrically feeding the plate radiator 302.

The balanced feeding structure of the fourth embodiment is described in greater detail with reference to FIGS. 4*a*, 4*b*, and 4*c*. Preferably, the probe-type feeding structure 406 is balanced and configured to feed the suspended plate antenna symmetrically about the center of the plate radiator 402. In this instance, the probe-type feeding structure 406 is a CPW-like structure 410 that consists of a probe feed 410 that is spaced apart from and in parallel with a ground wall 412, and a pair of ground strips 413 that is coplanar with the probe feed as shown in FIGS. 4*a*, 4*b*, and 4*c*. The width of the ground wall 412 is typically greater than the width of the probe feed 410, and each of the pair of coplanar ground strips 413 is spaced apart from each side of the probe feed 410 and in parallel therewith.

The probe feed 410, to which electrical signals are fed, is connected to a surface mount adapter (SMA) conductor 414 via a feedthrough in the ground plane 404 while the ground wall 412 and the pair of ground strips 413 are connected to the ground plane 404 in the proximity of the feedthrough. The ground point of the SMA conductor 414 is also connected to the ground plane 404 in the proximity of the feedthrough, but on the side of the ground plane 404 opposite the plate radiator 402. Input to or output from the suspended plate antenna is fed to the SMA conductor 414 and connected to external wireless communication devices.

The probe feed 410 and the ground wall 412 may be completely or partially separated by foam, or any other infinitely- or finitely-sized dielectric material 416 that is inserted into the space between the probe feed 410 and the ground wall 412.

A pair of feed points 418 are present on the plate radiator 402, each feed point 418 being located at the center of and proximal to the edge of each of the longer sides of a rectangular slot 408 cut in the center of the plate radiator 402 as described in the foregoing manner for the first embodiment. Each of the probe feed 410, and ground wall 412 and ground strips 413, is connected to each of the pair of feed points 418 for symmetrically feeding the plate radiator 402.

The balanced feeding structure of the fifth embodiment is described in greater detail with reference to FIGS. 5*a*, 5*b*, and 5*c*. Preferably, the probe-like feeding structure 506 is balanced and configured to feed the suspended plate antenna symmetrically about the center of the plate radiator 502. In this instance, the probe-type feeding structure 506 is a balance feeding system 506 that consists of a pair of parallel probe feeds 510, each of which carries signal being completely 180° out of phase with signals carried by the other, as shown in FIGS. 5*a*, 5*b*, and 5*c*.

The pair of probe feeds 510, to which electrical signals are fed completely out of phase, is connected to a balun 514 via a feedthrough in the ground plane 504. Each of the pair of probe feed 510 of the balun 514 is connected to the plate radiator 502. Input to or output from the suspended plate antenna is fed to the balun 514 and connected to external wireless communication devices.

A pair of feed points 518 are present on the plate radiator 502, each feed point 518 being located at the center of and proximal to the edge of each of the longer sides of a rectangular slot 508 cut in center of the plate radiator 502 as described in the foregoing manner for the first embodiment. Each of the pair of probe feed 510 is connected to each of the pair of feed points 518 for symmetrically feeding the plate radiator 502.

The balanced feeding structure of the sixth embodiment is described in greater detail with reference to FIGS. 6*a*, 6*b*, and 6*c*. Preferably, the probe-type feeding structure 606 is balanced and configured to feed the suspended plate antenna symmetrically about the center of the plate radiator 602. In this instance, the probe-type feeding structure 606 is a pair of inverted-L strips 606 that consists of an inverted-L probe feed 610 the longer side of which is spaced apart from and in parallel with the longer side of an inverted-L ground wire 612 as shown in FIGS. 6*a*, 6*b*, and 6*c*. The shorter sides of both the inverted-L probe feed 610 and inverted-L ground wire 612 are equally spaced apart from and in parallel with the plate radiator 602. Also, the longer and shorter sides of both the inverted-L probe feed 610 and inverted-L ground wire 612 are coplanar.

The inverted-L probe feed 610, to which electrical signals are fed, is connected to a surface mount adapter (SMA) conductor 614 via a feedthrough in the ground plane 104 in the proximity of the feedthrough The ground point of the SMA conductor 614 is also connected to the ground plane 604 in the proximity of the feedthrough, but on the side of the ground plane 604 opposite the plate radiator 602. Input to or output from the suspended plate antenna is fed to the SMA conductor 614 and connected to external wireless communication devices.

The suspended plate antennas according to embodiments of the invention may be used in applications requiring single element, array, or diversity antenna configurations. The balanced feeding structures are preferably used to symmetrical feed the suspended plate antennas and microstrip patch antennas as well as to suppress cross-polarization levels in the H-plane and improve the radiation patterns in the E-plane within a broad well-matched pass-band.

In the foregoing manner, a structure for feeding a broadband suspended plate antenna, and method therefor, which alleviates degraded radiation performance in the E- and H-planes are described. Although a number of embodiments are described, it is apparent to one skilled in the art in view of this disclosure that numerous changes and/or modifications may be made without departing from the scope and spirit of the invention. For example, the plate radiators may have shapes that are electrically and functionally similar to those that have been mentioned, but are not. Also, the plate radiators and ground planes may not necessarily be planar, and such variations allow the flexible implementation of such broadband suspended plate antennas to suit profiles of housings within which the antennas may be disposed. For example, the plate radiators may be curved or corrugated with V- or U-cross sections, or have other non-planar structures that are symmetrical about planes passing through the midlines of the plate radiators. The ground planes may not necessarily be parallel with the plate radiators, but like the plate radiators may also be curved or corrugated, or have other non-planar structures that are symmetrical with respect to the planes passing through the midlines of the plate radiators.

What is claimed is:

1. A suspended plate antenna for broadband applications, the antenna comprising:

a plate radiator;

a slot cut in the plate radiator;

a substantially balanced feeding structure symmetrically feeding the plate radiator with respect to at least one midline of the plate radiator.

2. The antenna as in claim 1, wherein the slot is symmetrical about at least one midline of the plate radiator.

3. The antenna as in claim 1, wherein the feeding structure symmetrically feeds the plate radiator with respect to the midline of the plate radiator about which the slot is symmetrical.

4. The antenna as in claim 1 wherein the plate radiator is one of rectangular, circular, triangular, bow-tie like, and trapezoidal shapes, or variations thereof.

5. The antenna as in claim 1, wherein the slot is rectangular or H-shaped or dog-bone like or bow-tie like.

6. The antenna as in claim 1, wherein the feeding structure is one of a pair of microstrip lines, a pair of close parallel wires, a pair of asymmetrical microstrip lines, a CPW or CPW-like structure, a balanced feeding system, and a pair of inverted-L feeding strips, or variations thereof.

7. The antenna as in claim 1, wherein the plate radiator is symmetrical about at least one plane passing through a midline of the plate radiator.

8. The antenna as in claim 1, further including a ground plane above which the plate radiator is suspended.

9. The antenna as in claim 8, wherein the ground plane is symmetrical about at least one plane passing through a midline of the plate radiator.

10. The antenna as in claim 9, wherein a space between the plate radiator and the ground plane is filled with dielectric material.

11. A method for feeding a suspended plate antenna for broadband applications, the method comprising the steps of:

providing a plate radiator;

providing a slot cut in the plate radiator; and using a substantially balanced feeding structure for symmetrically feeding the plate radiator with respect to and close to the center of the plate radiator.

12. The method as in claim 11, wherein the step of providing the slot cut includes the step of providing a cut slot which is symmetrical about at least one midline of the plate radiator.

13. The method as in claim 11, wherein the step of using the feeding structure includes the step of using the feeding structure for symmetrically feeding the plate radiator with respect to the midline of the plate radiator about which the slot is symmetrical.

14. The method as in claim 11, wherein the step of providing the plate radiator includes the step of providing the plate radiator having one of rectangular, circular, triangular, bow-tie like, and trapezoidal shapes, or variations thereof.

15. The method as in claim 11, wherein the step of providing the slot cut includes the step of cutting the slot which is rectangular or H-shaped or dog-bone like or bow-tie like.

16. The method as in claim 11, wherein the step of using the feeding structure includes the step of using the feeding structure which is one of a pair of microstrip lines, a pair of close parallel wires, a pair of asymmetrical microstrip lines, a CPW or CPW-like structure, a balanced feeding system, and a pair of inverted-L feeding strips, or variations thereof.

17. The method as in claim 11, wherein the step of providing the plate radiator further includes of providing a plate radiator which is symmetrical about at least one plane passing through a midline of the plate radiator.

18. The method as in claim 11, further including the step of providing a ground plane above which the plate radiator is suspended.

19. The method as in claim 18, wherein the step of providing the ground plane includes the step of providing a ground plane which is symmetrical about at least one plane passing through a midline of the plate radiator.

20. The method as in claim 19, wherein the step of providing the ground plane further includes the step of providing the ground plane wherein a space between the plate radiator and the ground plane is filled with dielectric material.

* * * * *

UNITED STATES PATENT AND TRADEMARK OFFICE

CERTIFICATE OF CORRECTION

PATENT NO. : 6,914,563 B2
APPLICATION NO. : 10/470326
DATED : July 5, 2005
INVENTOR(S) : Zhi N. Chen et al.

It is certified that error appears in the above-identified patent and that said Letters Patent is hereby corrected as shown below:

Please replace originally filed drawing pages 4 and 6 with the enclosed drawing pages.

Signed and Sealed this

Tenth Day of October, 2006

JON W. DUDAS
*Director of the United States Patent and Trademark Office*